US007354242B2

(12) United States Patent
Sassanelli

(10) Patent No.: US 7,354,242 B2
(45) Date of Patent: Apr. 8, 2008

(54) VARIABLE NOZZLE FOR A GAS TURBINE

(75) Inventor: Giuseppe Sassanelli, Florence (IT)

(73) Assignee: Nuovo Pignone Holding S.p.A., Florance (IT)

( * ) Notice: Subject to any disclaimer, the term of this patent is extended or adjusted under 35 U.S.C. 154(b) by 0 days.

(21) Appl. No.: 10/596,191

(22) PCT Filed: Nov. 30, 2004

(86) PCT No.: PCT/EP2004/013657

§ 371 (c)(1),
(2), (4) Date: Sep. 13, 2006

(87) PCT Pub. No.: WO2005/054633

PCT Pub. Date: Jun. 16, 2005

(65) Prior Publication Data

US 2007/0086886 A1 Apr. 19, 2007

(30) Foreign Application Priority Data

Dec. 5, 2003 (IT) ..... MI2003A2388

(51) Int. Cl.
*F01D 17/16* (2006.01)

(52) U.S. Cl. ..... 415/151; 415/160

(58) Field of Classification Search ..... 415/148, 415/151, 155, 159–165
See application file for complete search history.

(56) References Cited

U.S. PATENT DOCUMENTS

| | | | | |
|---|---|---|---|---|
| 3,685,921 | A * | 8/1972 | Dekeyser | 415/159 |
| 4,172,361 | A | 10/1979 | Kronogar | |
| 4,995,786 | A | 2/1991 | Wheeler et al. | |
| 5,088,892 | A | 2/1992 | Weingold et al. | |
| 2002/0614249 | | 5/2002 | Caubet et al. | |

FOREIGN PATENT DOCUMENTS

| | | |
|---|---|---|
| DE | 19950227 | 11/2000 |

* cited by examiner

*Primary Examiner*—Christopher Verdier
(74) *Attorney, Agent, or Firm*—GE Global Patent Operation; Mardson Q. McQuay

(57) ABSTRACT

Variable nozzle (10) for a gas turbine fixed to a shaft (11) equipped with a pressurized upper surface (12) and a depressurized lower surface (14) opposite to the upper surface (12), the variable nozzle comprises a series of substantially "C"-shaped sections, each having a first rounded end (20) and a second rounded end (21), each section of the series of sections also having the concavity facing upwards with respect to a base (90) and arranged one after another continuously, in the direction of an axis of the shaft (11) along a curved line (60), the at least second degree curved line (60) lies on a surface (70) having an axis orthogonal to the axis of the shaft (11) and also tilted with respect to the base (90) by an angle (80).

7 Claims, 3 Drawing Sheets

VARIABLE NOZZLE FOR A GAS TURBINE

The present invention relates to a nozzle for a gas turbine, which can be particularly applied to the first stage of a power turbine.

The present invention relates to a twin-shaft gas turbine and in particular, to a variable nozzle for a low pressure turbine.

Normally in twin-shaft turbines, the air pressurized by a compressor, is mixed with a combustible fluid and injected into a burner to generate hot combusted gases.

The latter flow through the nozzles of a high pressure turbine, which diverges them and accelerates them.

Downstream of the high pressure turbine, the gases then pass through a low pressure turbine, which extracts the remaining energy to feed a user.

Gas turbines for mechanical operations can have a fixed or variable nozzle, placed in the first stage of the low pressure turbine.

When using a variable nozzle, it is possible to obtain a high operability of the turbine, at the same time maintaining the polluting emissions and efficiency of the turbine as constant as possible.

A fixed nozzle, on the other hand, is characterized by a higher aerodynamic efficiency accompanied however by a lower operability of the gas turbine.

For variable nozzles, there are clearances necessary for allowing its rotation.

A variable nozzle has two surfaces touched by hot combusted gases, opposite each other, of which one is pressurized and the other depressurized.

One of the disadvantages of a variable nozzle is that it has aerodynamic efficiency losses due to pressure drop losses of the flow of combusted gases through the clearances, accompanied by secondary losses arising from the latter, which are mainly due to the pressure differences between the pressurized surface and the depressurized surface.

An objective of the present invention is to provide a variable nozzle for a gas turbine, having improved performances which resemble those of a fixed nozzle, at the same time maintaining a high operability of the gas turbine with variations in its flow-rates.

Another objective of the present invention is to provide a reliable variable nozzle for a gas turbine.

These objectives according to the present invention are achieved by providing a variable nozzle for a gas turbine as illustrated in the claims.

Further characteristics of the invention are indicated in the subsequent claims.

The characteristics and advantages of a variable nozzle for a gas turbine according to the present invention will appear more evident from the following, illustrative and non-limiting description, referring to the enclosed schematic drawings, in which.

Figure 1:
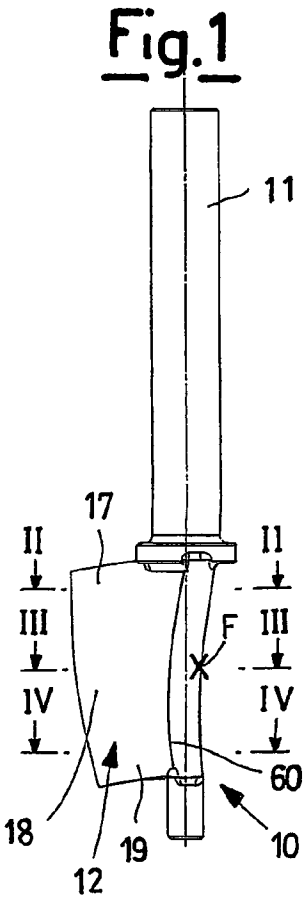
FIG. 1 is a raised front view of a variable nozzle according to the present invention.
Figure 6:
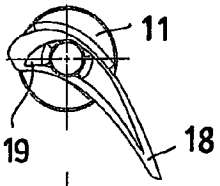
FIG. 6 is a view from below of the nozzle of FIG. 1.
Figure 7:
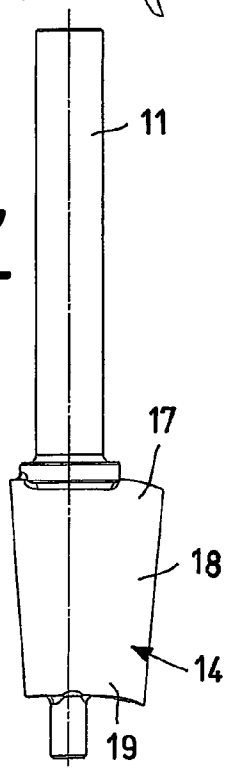
FIG. 7 is a raised side view of the nozzle of FIG. 1.
Figure 8:
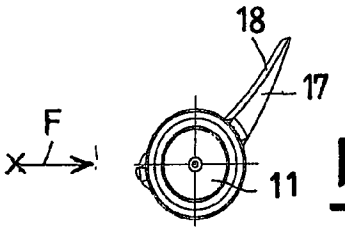
FIG. 8 is a view from above of the nozzle of FIG. 1.
Figure 9:
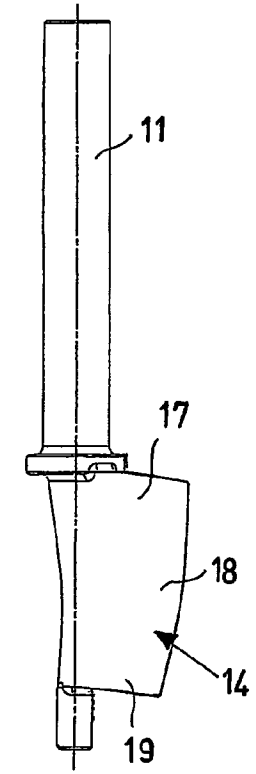
FIG. 9 is a raised rear view of the nozzel of FIG. 1.
Figure 2:
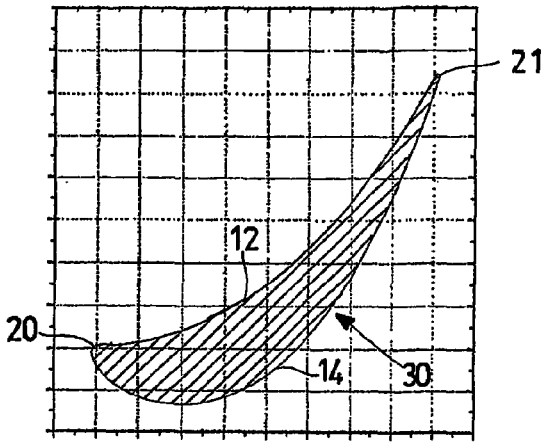
FIG. 2 is a raised sectional front view of the nozzle of FIG. 1 according to a line II-II passing through an upper end of the variable nozzle.
Figure 3:
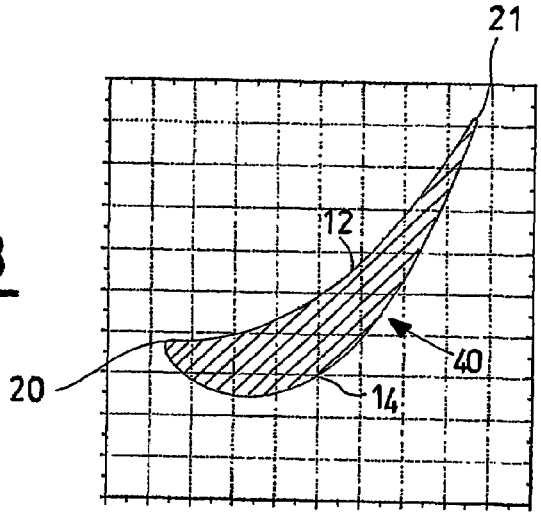
FIG. 3 is a raised sectional front view of the nozzle of FIG. 1, according to a line III-III passing through the intermediate part of the variable nozzle.
Figure 4:
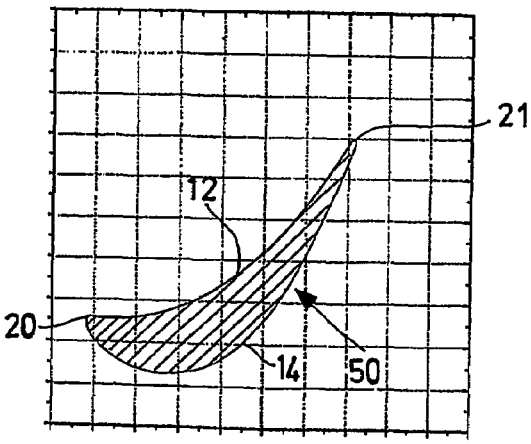
FIG. 4 is a raised sectional front view of the nozzle of FIG. 1 according to a line IV-IV passing through the hub of the variable nozzle.
Figure 5:
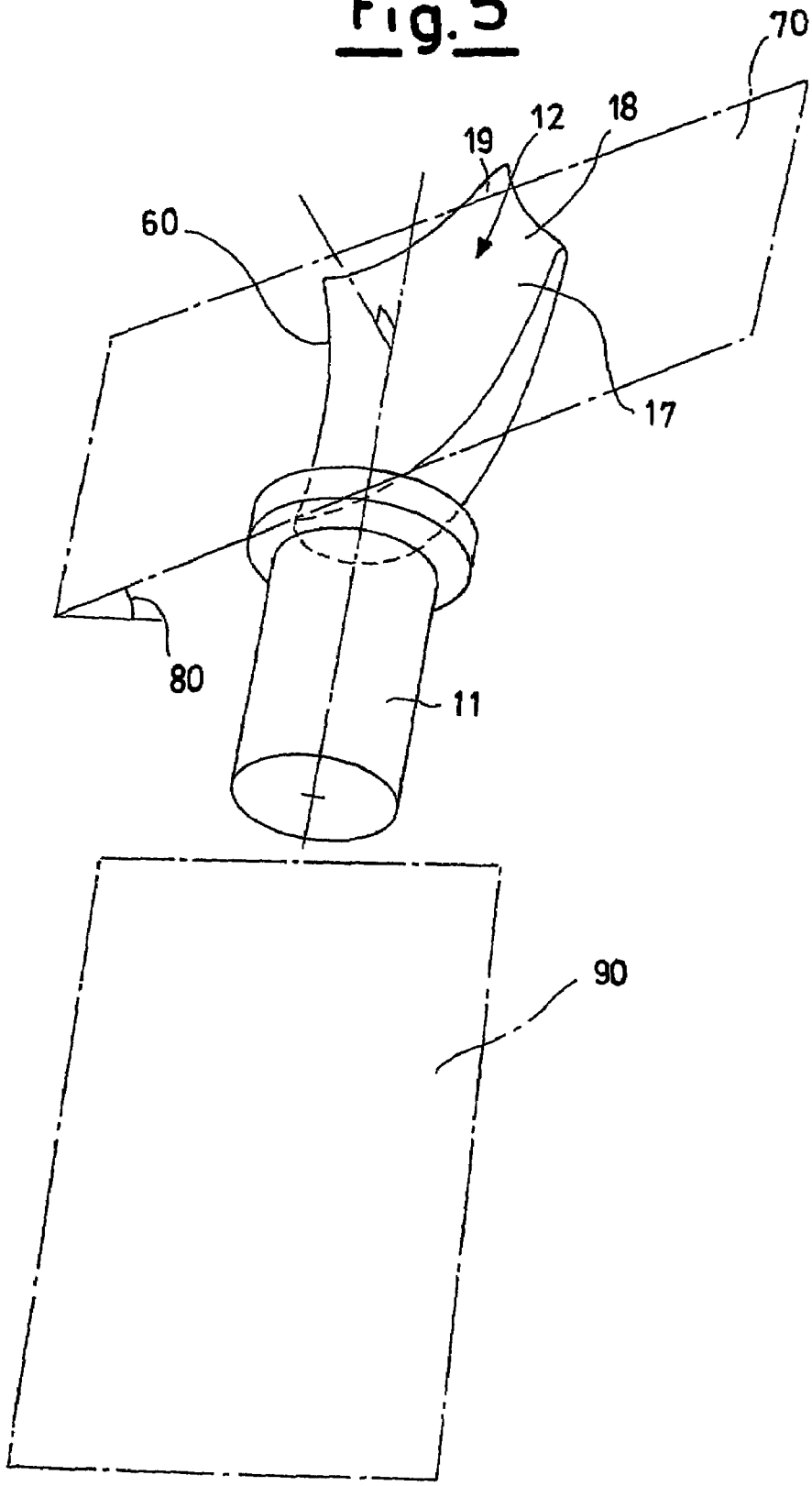
FIG. 5 is a perspective view of the nozzle of FIG. 1.

With reference to the figures, these show a variable nozzle 10 for a gas turbine fixed to a shaft 11 and capable of being rotated around its axis by means of activating means not shown in the figures.

The shaped variable nozzle 10 is suitable for minimizing pressure drops and consequently increasing the efficiency of the gas turbine.

Said variable nozzle 10 has a series of sections, preferably variable, substantially "C"-shaped, all facing the same direction, and preferably with the concavity facing upwards with respect to a base 90.

Each section of the series of sections represents a section of the variable nozzle 10 according to a surface having an axis parallel to the axis of the shaft 11.

Each section of the series of sections has a first rounded end 20 and a second rounded end 21.

The first end 20 of each section of the series of sections is situated along the axis of the shaft 11 according to an at least second degree curved line 60.

The series of sections is positioned along the axis of the shaft 11 and respectively defines two surfaces, an upper pressurized surface 12 and an opposite lower surface 14, which is depressurized, respectively, both touched by the hot combusted gases.

The pressure of the flow F of hot gas is exerted on the upper surface 12, whereas the opposite lower surface 14, is in depression.

The upper surface 12 is saddle-shaped and its saddle point corresponds to the intermediate section of the variable nozzle 10.

The upper surface 12, in a parallel direction to the axis of the shaft 11, is therefore convex, whereas in an orthogonal direction to said axis, it is concave, all the sections being substantially "C"-shaped.

The variable nozzle 10 has a first end portion 17, a second central portion 18, and a third hub portion 19.

The first portion 17 and the third portion respectively comprise an end section 30 and a hub section 50, which have minimum aerodynamic pressure drops which consequently improve the aerodynamic efficiency of the variable nozzle 10.

Furthermore, the pressure differences which are created between the upper pressurized surface 12 and the lower depressurized surface 14, always in respective correspondence with said end section 30 and said hub section 50, are minimum and consequently the secondary aerodynamic losses are also minimum.

The forces which guide the flow of combusted gases through the clearances are thus reduced.

The second central portion 18, on the other hand, comprises the intermediate section 40.

There are no edge effects or secondary losses in correspondence with the second central portion 18, and consequently the aerodynamic efficiency in this portion of the variable nozzle 10 is greater.

For this reason, as there is a greater aerodynamic efficiency in the second central portion 18, the variable nozzle 10 is shaped so as to increase the aerodynamic charge thereon.

These results are also maintained with variations in the operating conditions of the gas turbine.

All of this is obtained by shaping the variable nozzle 10, positioning each section of the series of sections continuously one after another, and arranging the first end of each section of the series of sections in the direction of the axis of the shaft 11, along the at least second degree curved line 60.

Said curved line 60 lies on a surface 70 having an axis orthogonal to the axis of the shaft 11 and also tilted with respect to the base 90 by an angle 80 different from 0° and lower than 90°.

Said curved line 60 is an at least second degree line and comprises a parabolic line or a hyperbolic line or a combination of these.

In a first preferred embodiment, said curved line 60 is preferably a parabolic line.

The variable nozzle 10 is therefore an arched nozzle, preferably parabolically arched.

In a second embodiment, said curved line 60 is preferably a hyperbolic line.

In a third embodiment, said curved line 60 is preferably a third degree line.

Said curved line 60, moreover, preferably has a maximum or minimum point.

It can thus be seen that a variable nozzle for a gas turbine according to the present invention achieves the objectives specified above.

Numerous modifications and variants can be applied to the variable nozzle for a gas turbine of the present invention, thus conceived, all included within the same inventive concept.

Furthermore, in practice, the materials used as also the dimensions and components, can vary according to technical demands.

The invention claimed is:

1. A variable nozzle (10) for a gas turbine fixed to a shaft (11), said variable nozzle (10) comprising a pressurized upper surface (12) and a depressurized lower surface (14) opposite to the upper surface (12), wherein the variable nozzle comprises a series of substantially "C"-shaped sections, each having a first rounded end (20) and a second rounded end (21), each section of the series of sections also having the concavity facing upwards with respect to a base (90) and arranged one after another continuously, in the direction of an axis of the shaft (11) along an at least second degree curved line (60), wherein said at least second degree curved line (60) lies on a surface (70) having an axis orthogonal to the axis of the shaft (11) and also tilted with respect to the base (90) by an angle (80).

2. The variable nozzle (10) according to claim 1, wherein said curved line (60) is a parabolic line.

3. The variable nozzle (10) according to claim 1, wherein said curved line (60) is a hyperbolic line.

4. The variable nozzle (10) according to claim 1, wherein said curved line (60) is a combination of a parabolic line and a hyperbolic line.

5. The variable nozzle (10) according to claim 1, wherein said curved line (60) is a third degree line.

6. The variable nozzle (10) according to any of the previous claims, wherein said curved line (60) has a maximum or minimum point.

7. The variable nozzle (10) according to any of claims 1 through 5, wherein the upper surface (12) is saddle-shaped.

* * * * *

UNITED STATES PATENT AND TRADEMARK OFFICE

CERTIFICATE OF CORRECTION

PATENT NO. : 7,354,242 B2
APPLICATION NO. : 10/596191
DATED : April 8, 2008
INVENTOR(S) : Sassanelli It is certified that error appears in the above-identified patent and that said Letters Patent is hereby corrected as shown below:

On the Title Page, in Field (73), under “Assignee”, in Column 1, Line 2, delete “Florance” and insert -- Florence --, therefor.

In Column 2, Line 3, delete “nozzel” and insert -- nozzle --, therefor.

Signed and Sealed this

Twenty-first Day of April, 2009

John Doll

JOHN DOLL
*Acting Director of the United States Patent and Trademark Office*